United States Patent [19]

Murayama et al.

[11] 4,407,919

[45] Oct. 4, 1983

[54] ELECTROPHOTOGRAPHIC PLATE

[75] Inventors: Tetsuo Murayama, Machida; Shigenori Otsuka, Tokyo; Tsunemitsu Tajima, Kawasaki; Yukihiro Sato, Yokohama, all of Japan

[73] Assignee: Mitsubishi Chemical Industries Limited, Tokyo, Japan

[21] Appl. No.: 390,842

[22] Filed: Jun. 22, 1982

[30] Foreign Application Priority Data

Jul. 7, 1981 [JP] Japan ..... 56-105954

[51] Int. Cl.[3] ..... G03G 5/14

[52] U.S. Cl. ..... 430/58; 252/500

[58] Field of Search ..... 430/58; 252/500

[56] References Cited

U.S. PATENT DOCUMENTS 3,615,384 10/1971 Gipstein et al. ..... 430/75

FOREIGN PATENT DOCUMENTS 7404414 11/1974 Netherlands ..... 430/58

*Primary Examiner*—John D. Welsh

*Attorney, Agent, or Firm*—Oblon, Fisher, Spivak, McClelland & Maier

[57] ABSTRACT

A double-layered electrophotographic plate having at least a charge generating layer and a charge transporting layer on an electroconductive substrate, wherein said charge transporting layer comprises (a) a dicyano vinyl compound represented by general formula (I):

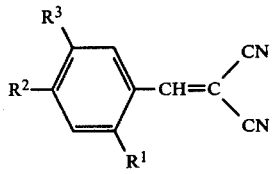

(I)

where $R^1$ and $R^3$ independently represent hydrogen, halogen, cyano, nitro or a substituted- or unsubstituted-arylcarbonyloxy group, and $R^2$ represents hydrogen, halogen, cyano or a substituted- or unsubstituted-arylcarbonyloxy group with the proviso that $R^1$, $R^2$ and $R^3$ are not simultaneously hydrogen, and/or a dicyano vinyl compound represented by general formula (II):

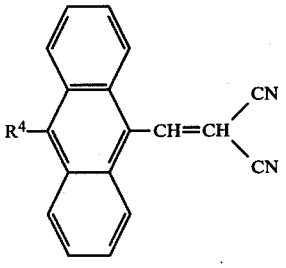

(II)

where $R^4$ represents hydrogen, halogen, lower alkyl or aryl group, and (b) an electron-donating organic compound.

5 Claims, No Drawings

ELECTROPHOTOGRAPHIC PLATE

BACKGROUND OF THE INVENTION

1. Field of the Invention

The present invention relates to an electrophotographic plate and, more specifically, it relates to a double-layered electrophotographic plate with excellent durability.

2. Description of the Prior Art

Inorganic photoconductive materials such as selenium, cadmium sulfide and zinc oxide have been popularly used for the photosensitive layers of electrophotographic plates.

Studies on use of organic photoconductive materials typically represented by polyvinylcarbazole for the photosensitive layer have been advanced and several of them have been put to practical use. The organic photoconductive materials are advantageous over the inorganic photoconductive materials in that they are light in weight, can be made into films and fabricated into photosensitive bodies with ease. Further, since selenium and cadmium sulfide have to be recovered in view of their toxicity, increasing attention has been attracted more and more to the non-toxic organic photoconductive materials in recent years. The organic photoconductive materials, although having such advantages, have not hitherto been used so much as the electrophotographic plates, because they are inferior to the inorganic photoconductive materials in view of the sensitivity and the durability.

Recent endeavor has been devoted to the development of laminated type photosensitive bodies of a double layer structure consisting of a charge generating layer and a charge transporting layer, in which a function of generating charge carriers upon absorption of light and a function of transporting the charge carriers thus generated are sheared to each of the layers. As the result, high sensitivity organic electrophotographic plates have been put to practical use by combining respective organic compounds as a charge generator and as a charge transporting medium each having a high efficiency for the sheared function.

Usually, photoconductive organic dyes are employed as the charge generating layer and the polymers such as polyvinyl carbazole are used as the charge transporting layer for the double-layered electrophotographic plates. Recently, the charge transporting layers have often been prepared by dissolving electron-donating low molecular organic compounds, as the charge transporting medium, into insulating binder polymers. In this case, the performance such as the bondability with the lower layer, the surface hardness and the flexibility can be improved by the adequate selection for the binder polymers, whereby photosensitive bodies of excellent performance can be obtained.

Thus, the double-layered electrophotographic plates are advantageous in that the performance thereof can be improved by shearing various functions into each of the constituent layers but they still give rise to several problems.

In a double-layered electrophotographic plate, carriers generated upon absorption of light into charge generators in a charge generating layer are injected into and transported through a charge transporting layer. However, if traps are present due to impurities or the likes in the charge transporting layer, the carriers are caught in the traps to increase the residual potential and the carriers may sometimes be caught also at the interface between the charge generating layer and the charge transporting layer. Thus, the residual potential is gradually increased upon repeated use of the electrophotographic plate thereby tending to result in foggings in the photographic images. Such traps are provably formed, it is considered, due to the energy barrier at the interface between the charge generating layer and the charge transporting layer, the state of the interface, presence of the impurities in the constituent members such as the binder polymer and, further, due to the repeated exposure to electrical fields generated from corona discharge or to the light of imagewise exposure and cleaning lamps. In order to avoid such an increase in the residual potential, elimination of impurities in the material to be used or addition of various electron accepting compounds has been attempted. However, the former complicates the purification procedures and thus increases the production cost. While on the other hand, the latter often increases the dark decay, causes fluctuations in the surface potential upon repeated use, decreases the sensitivity and can not always provide a sufficient suppressing effect for the residual potential.

SUMMARY OF THE INVENTION

As a result of the detailed study on electron accepting compounds having excellent suppressing effects for the residual potential and giving less effects on electrical properties such as sensitivity, charging property and dark decay, it has now been found that the above object can be attained by dicyano vinyl compounds of a particular type.

The present invention resides in a double-layered electrophotographic plate having at least a charge generating layer and a charge transporting layer on an electroconductive substrate, wherein said charge transporting layer comprises (a) a dicyano vinyl compound represented by general formula (I):

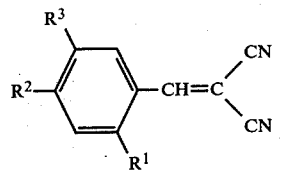

(I)

where $R^1$ and $R^3$ which may be the same or different represent hydrogen, halogen, cyano, nitro or a substituted- or unsubstituted-arylcarbonyloxy group, and $R^2$ represents hydrogen, halogen, cyano or a substituted- or unsubstituted-arylcarbonyloxy group with the proviso that $R^1$, $R^2$ and $R^3$ are not simultaneously hydrogen, and/or a dicyano vinyl compound represented by general formula (II):

(II)

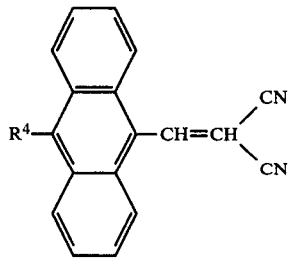

where $R^4$ represents hydrogen, halogen, lower alkyl or aryl group, and (b) an electron-donating organic compound.

DETAILED DESCRIPTION OF THE PREFERRED EMBODIMENTS

The charge transporting layer in the electrophotographic plate according to the present invention comprises (a) a dicyano vinyl compound and (b) an electron-donating organic compound.

The dicyano vinyl compound (a) for use in the present invention is represented by general formula (I) and/or by general formula (II) as mentioned above. In general formula (I), $R^1$ and $R^3$ independently represent hydrogen; halogen such as chlorine, fluorine and bromine; cyano; nitro; or arylcarbonyloxy group such as phenylcarbonyloxy, naphthylcarbonyloxy and anthrylcarbonyloxy which may be substituted with one or more groups such as alkyl, alkoxy, halogen, cyano and nitro, $R^2$ represents hydrogen; halogen such as chlorine, fluorine and bromine; cyano; or arylcarbonyloxy group such as phenylcarbonyloxy, naphthylcarbonyloxy and anthrylcarbonyloxy which may be substituted with one or more groups such as alkyl, alkoxy, halogen, cyano and nitro. In general formula (I), $R^1$, $R^2$ and $R^3$ are not simultaneously hydrogen. In general formula (II), $R^4$ represents hydrogen; halogen such as chlorine and bromine; lower alkyl such as methyl, ethyl and butyl; or aryl such as phenyl. In view of the suppressing effect for the residual potential, preferred dicyano vinyl compounds are those represented by the general formula (I) where $R^1$ is hydrogen, halogen or nitro, $R^2$ is hydrogen, halogen or arylcarbonyloxy and $R^3$ is hydrogen or halogen and those represented by the general formula (II) where $R^4$ is hydrogen.

The electron-donating organic compound (b) for use in the present invention acts as the carrier transporting medium and it includes, for example, heterocyclic compounds such as indole, carbazole, imidazole, oxazole, thiazole, oxadiazole, pyrazole, pyrazoline, thiadiazole, benzoxazole, benzthiazole and benzimidazole, aromatic hydrocarbons such as benzene, naphthalene, anthracene, fluorene, perylene, pyrene, phenylanthracene and styrylanthracene; derivatives of the above-mentioned compounds such as those substituted with electron-donating groups such as alkyl, alkoxy, amino and substituted amino; and other derivatives of the above-mentioned compounds, for example, triaryl alkane such as leuco crystal violet, triaryl amine, 1,2-diarylethylene, chalcone derivative, hydrazine derivative and hydrazone compounds. It further includes those polymers containing radicals of the above-mentioned compounds in the main skelton or branched side chains, for example, polyvinyl carbazole, polyglycidyl carbazole and polystyryl anthracene.

In the above compounds, those having an ionization potential of less than 7.5 eV are preferred as the charge transporting medium, and particularly preferred are hydrazone compounds represented by the following general formula (III):

(III)

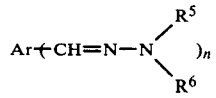

where Ar represents a substituted or unsubstituted aromatic hydrocarbon group, for example, phenyl group, or an aromatic heterocyclic group, for example, carbazolyl group, $R^5$ and $R^6$ independently represent alkyl group, for example, methyl and ethyl, aryl, for example, phenyl or aralkyl, for example, benzyl and n is an integer of 1 or 2.

In the present invention, the binder polymer is usually employed for dispersing the electron-donating organic compound (b) into the charge transporting layer. Such binder polymer includes polymer or copolymer of vinyl compounds such as styrene, vinyl chloride, vinyl acetate, acrylic ester and methacrylic ester, phenoxy resin, polysulfone, polyvinyl acetal, polycarbonate, polyester, cellulose ester, cellulose ether, silicone resin, urethane resin, epoxy resin, and unsaturated polyester, which are compatible with the electron-donating organic compound (b). If the electron-donating organic compound (b) is a polymer it can of course be used also as the binder.

In the present invention, the dicyano vinyl compound (a) is used in a range usually from 0.0001 to 0.3 times by weight and, preferably, from 0.0005 to 0.15 times by weight of the electron-donating compound (b). The electron-donating compound (b) is used in a range usually from 0.2 to 1.5 times by weight and, preferably, from 0.3 to 1.2 times by weight of the binder polymer. Further, well-known plasticizers may be incorporated into the charge transporting layer in the present invention for improving the film-forming property, the flexibility and the mechanical strength. Such plasticizers include phthalic ester, phosphoric ester, epoxy compound, chlorinated paraffin, chlorinated fatty acid ester and aromatic compound such as methyl naphthalene.

The charge transporting layer of the present invention incorporating each of the ingredients as mentioned above may be disposed on the charge generating layer containing the charge generators placed on the electroconductive substrate or between the electroconductive substrate and the charge generating layer by any conventional method. The former is preferred in view of the durability. The charge generator contained in the charge generating layer includes, for example, known inorganic photoconductive compounds such as selenium or selenium alloy, for example, selenium-tellurium and selenium-arsenic; cadmium sulfide, as well as known organic photoconductive compounds such as condensed ring dyes, for example, phthalocyanine and copper phthalocyanine; perinone, perylene, thioindigo, quinacridone, anthraquinone and dioxane; azo dyes; bisazo dyes; cyanine dyes, with the organic photoconductive compounds being preferred in view of toxicity.

The charge generating layer is provided on the conductive substrate by any usual method such as vapor deposition, or the layer is disposed by dispersing particles of the charge generator, optionally, with the binder polymer into a coating liquid and then applying them onto the electroconductive substrate or the charge transporting layer.

The electroconductive substrate for use in the present invention includes various known substrates, for example, a drum or sheet, as well as foil-laminated product or vapor deposition product made of metal such as aluminum and copper. It further includes a plastic film, a plastic drum or paper which is electrified by the application of a coating containing conductive material such as metal powder, carbon black, carbon fiber, copper iodide and high molecular electrolyte, optionally, with binder polymer.

The electrophotographic plate of the present invention thus obtained is excellent in the effect for suppressing the residual potential and has an extremely high durability in that the electrical properties thereof are not impaired even after the repeated use. The electrophotographic plate according to the present invention can be applied generally to the various application fields of electrophotography, for example, as the photosensitive plate for use in an electrophotographic reproducing machines, as well as in a printer using laser means, cathode ray tubes or the likes as the optical source. Having generally described the invention, a further understanding can be obtained by reference to certain specific examples which are provided herein for purpose of illustration only and are not intended to be limiting unless otherwise specified.

EXAMPLES 1-5 AND COMPARATIVE EXAMPLES 1-2

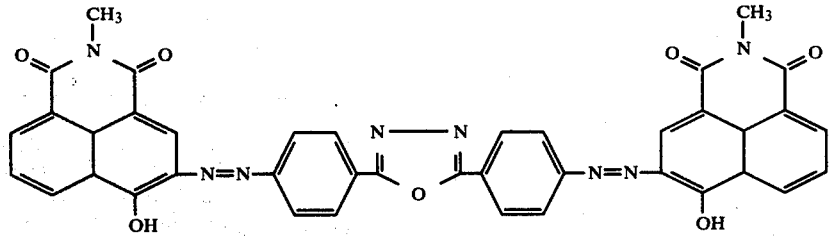

1 part of a bisazo compound having the above structural formula and 1 part of a polyester (Vylon 200, Trade mark, manufactured by Toyobo Co., Ltd.) were added to 90 parts of tetrahydrofuran and they were subjected to a dispersing treatment by a sand grinder. Thereafter, the dispersion was coated on the vapor-deposited surface of a polyester film of 100 μm thickness which had been vapor-deposited with aluminum so as to provide 0.2 g/m$^2$ of coating amount after drying to form a charge generating layer.

A solution prepared by dissolving 80 parts of N-ethylcarbazole-3-aldehyde diphenylhydrazone, 100 parts of methacrylic resin (Dianal BR-80, manufactured by Mitsubishi Rayon Co., Ltd.) and 4 parts of the dicyano vinyl compound shown in Table 1 into 567 parts of toluene was coated on the charge generating layer thus prepared so as to provide a coating film in the dry thickness of 12-13 μm to prepare a charge transporting layer. The sensitivity of electrophotographic plate having two photosensitive layers thus prepared was measured in the procedures described below.

The photosensitive plate was at first charged in a dark place by corona discharge at −6 KV and then exposed to incandescent light at 5 lux to determine the exposure intensity required for decreasing the surface potential on the photosensitive plate from −500 V to −250 V as a half-decay exposure intensity.

Then, the value for the residual potential on the photosensitive plate upon charging and exposure was measured after exposing the photosensitive plate to the light of an incandescent fluorescent lamp at the luminosity of 10,000 lux for 5 minutes and leaving it in the dark place for 5 minutes, in order to determine the effect of the optical irradiation. The results are shown in Table 1.

As appararent from the Table 1, while the value of the residual potential on the photosensitive plate according to the present invention was very small, the value of the residual potential in the comparative example was increased after the exposure to the light at 10,000 lux.

TABLE 1

| | Dicyano vinyl compound | Half-decay exposure intensity (lux.sec) | Residual potential (V) |
|---|---|---|---|
| Example 1 | 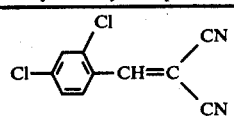 | 4.1 | −7 |
| Example 2 | 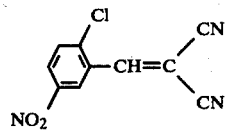 | 4.4 | −2 |
| Example 3 | 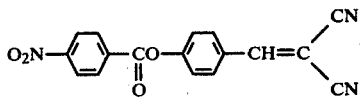 | 4.0 | −12 |

TABLE 1-continued

| | Dicyano vinyl compound | Half-decay exposure intensity (lux.sec) | Residual potential (V) |
|---|---|---|---|
| Example 4 | 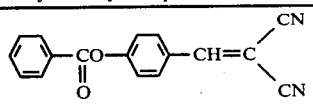 | 4.0 | −13 |
| Example 5 | 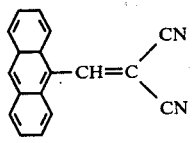 | 4.1 | −14 |
| Comparative Example 1 | 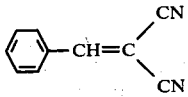 | 4.1 | −201 |
| Comparative Example 2 | 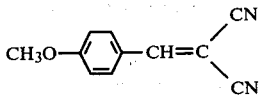 | 4.0 | −302 |

EXAMPLE 6

A photosensitive plate was prepared quite in the same manner as in Example 2 excepting that the addition amount for the dicyano vinyl compound was changed from 4 parts to 2 parts.

The residual potential on the photosensitive plate was −8 V when measured under the same conditions as in Example 2.

EXAMPLE 7

A photosensitive plate was prepared quite in the same manner as in Example 3 excepting that the addition amount for the dicyano vinyl compound was changed from 4 parts to 4.5 parts.

The durability for the photosensitive plate was tested in an electrostatic paper analyzer (Model SP-428 manufactured by Kawaguchi Denki Seisakujo). When corona discharge at −5.5 KV and optical exposure at 5 lux were applied cyclically, the surface potential at the initial stage was −515 V while the surface potential after 2,000 cycles was −510 V. Upon measuring the surface potential after the exposure to 50 lux.sec of light amount as the residual potential, the potential at the initial stage was −15 V while the potential after the 2,000 cycles was −30 V.

Further, sensitivity was extremely stable being fluctuated only for 0.2 lux.sec through the 2,000 cycles.

EXAMPLE 8 AND COMPARATIVE EXAMPLE 3

A photosensitive plate was prepared quite in the same manner as in Example 5 excepting that 80 parts of 4-(diethylamino)-benzaldehyde diphenyl hydrazone were used instead of 80 parts of N-ethylcarbazole-3-aldehyde diphenyl hydrazone for the charge transporting layer. Upon measuring the sensitivity and the residual potential of the photosensitive plate in the same manner as in Example 5, they were 5.5 lux sec and −7 V respectively.

The residual potential increased to −235 V if the additive, 9-(β,β-dicyano vinyl)-anthracene was removed from the photosensitive plate (Comparative Example 3), which exhibited that the dicyano vinyl compound has an effect for suppressing the residual potential.

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A double-layered electrophotographic plate having at least a charge generating layer and a charge transporting layer on an electroconductive substrate, wherein said charge transporting layer comprises (a) a dicyano vinyl compound represented by general formula (I):

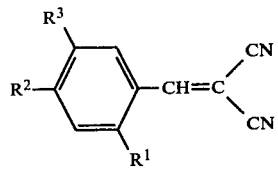

(I)

where $R^1$ and $R^3$ independently represent hydrogen, halogen, cyano, nitro or a substituted- or unsubstituted-arylcarbonyloxy group, and $R^2$ represents hydrogen, halogen, cyano or a substituted- or unsubstituted-arylcarbonyloxy group with the proviso that $R^1$, $R^2$ and $R^3$ are not simultaneously hydrogen, and/or a dicyano vinyl compound repreented by general formula (II):

(II)

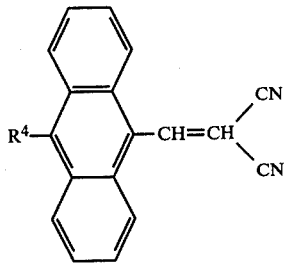

where $R^4$ represents hydrogen, halogen, lower alkyl or aryl group, and (b) an electron-donating organic compound.

2. The double-layered electrophotographic plate of claim 1 wherein $R^2$ is halogen.

3. The double-layered electrophotographic plate of claim 1 wherein $R^2$ is a substituted- or unsubstituted-arylcarbonyloxy group.

4. The double-layered electrophotographic plate of claim 1 wherein said electron-donating organic compound is selected from the group consisting of a heterocyclic compound; an aromatic hydrocarbon derivative substituted with an electron-donating group; and a hydrozone compound.

5. The double-layered electrophotographic plate of claim 4 wherein said hydrazone compound is represented by the following general formula (III).

(III)

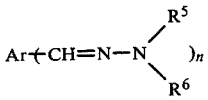

where Ar represents a substituted or unsubstituted aromatic hydrocarbon group or an aromatic heterocyclic group, $R^5$ and $R^6$ independently represent alkyl, aryl or aralkyl, and n is an integer of 1 or 2.

* * * * *

UNITED STATES PATENT AND TRADEMARK OFFICE

CERTIFICATE OF CORRECTION

PATENT NO. : 4,407,919

DATED : OCTOBER 4, 1983

INVENTOR(S) : TETSUO MURAYAMA ET AL

It is certified that error appears in the above-identified patent and that said Letters Patent is hereby corrected as shown below:

In the abstract delete "

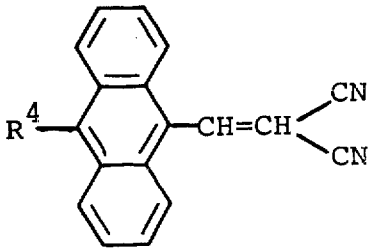

"

and insert therefor --

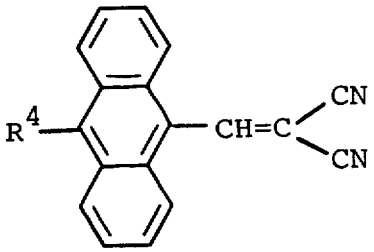

--.

UNITED STATES PATENT AND TRADEMARK OFFICE

CERTIFICATE OF CORRECTION

PATENT NO. : 4,407,919

DATED : OCTOBER 4, 1983

INVENTOR(S) : TETSUO MURAYAMA ET AL

It is certified that error appears in the above-identified patent and that said Letters Patent is hereby corrected as shown below:

Column 3, line 5, delete "

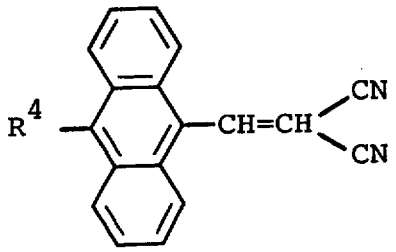

"

and insert therefor --

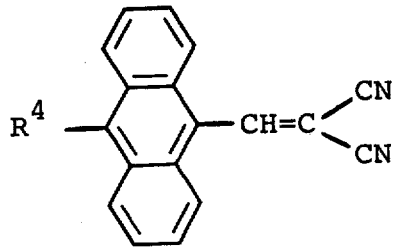

--.

UNITED STATES PATENT AND TRADEMARK OFFICE

CERTIFICATE OF CORRECTION

PATENT NO. : 4,407,919

DATED : OCTOBER 4, 1983

INVENTOR(S) : TETSUO MURAYAMA ET AL

It is certified that error appears in the above-identified patent and that said Letters Patent is hereby corrected as shown below:

Column 9, Claim 1, line 10, delete "

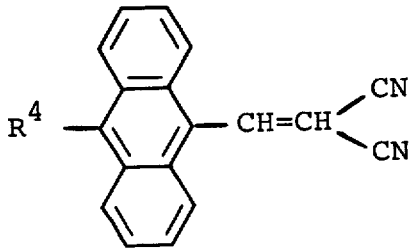

"

and insert therefor --

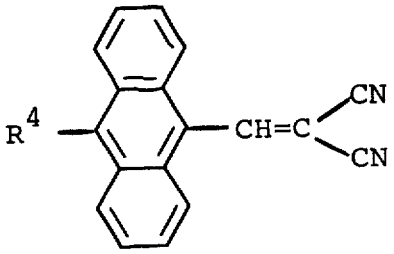

-- .

Signed and Sealed this

Fourteenth Day of August 1984

[SEAL]

Attest:

GERALD J. MOSSINGHOFF

Attesting Officer

Commissioner of Patents and Trademarks